United States Patent [19]

Wallace

[11] Patent Number: 4,841,853

[45] Date of Patent: Jun. 27, 1989

[54] APPARATUS FOR COMPACING GARBAGE AND SALVAGE

[75] Inventor: Eugene L. Wallace, Richmond, Canada

[73] Assignee: Wallace Disposal, British Columbia, Canada

[21] Appl. No.: 91,738

[22] Filed: Aug. 31, 1987

[51] Int. Cl.[4] ..... B30B 15/32

[52] U.S. Cl. ..... 100/245; 100/170; 100/218; 100/229 A; 100/255; 100/295; 294/68.21; 294/68.3

[58] Field of Search ..... 376/262, 263; 294/106, 294/86.41, 86.4, 68.3, 68.21; 414/739, 732; 220/94 A, 1 T; 100/295, 170, 246, 255, 249, 227, 226, 245, 218, 54, 55, 229 R, 229 A

[56] References Cited

U.S. PATENT DOCUMENTS

| | | | |
|---|---|---|---|
| 3,273,728 | 9/1966 | Kelso | 100/295 |
| 3,528,366 | 9/1970 | Nevenburg | 100/295 X |
| 3,756,150 | 9/1973 | Bourgeois . | |
| 3,765,148 | 10/1973 | Ippolito et al. . | |
| 3,828,663 | 8/1974 | Poplinski | 100/249 X |
| 3,861,296 | 1/1975 | Clar . | |
| 3,862,595 | 1/1975 | Longo . | |
| 3,869,978 | 3/1975 | Steinberg et al. . | |
| 3,911,807 | 10/1975 | Birnbaum . | |
| 3,921,515 | 11/1975 | Eckerle et al. . | |
| 3,945,314 | 3/1976 | Hennells . | |
| 4,144,806 | 3/1979 | Broussard | 100/218 X |
| 4,423,831 | 1/1984 | Sipley | 294/68.21 X |
| 4,483,248 | 11/1984 | Ostreng | 100/902 X |

*Primary Examiner*—Andrew M. Falik

*Attorney, Agent, or Firm*—Christie, Parker & Hale

[57] ABSTRACT

A compactor comprising a frame with a fluid operated, double acting ram mounted on the frame. A compactor plate is slidably mounted in the frame to be reciprocable by the ram. A back plate is positioned at an end of the frame remote from the ram. A container receives material to be compacted. The container is mounted adjacent the back plate. The container is open ended and has a top, sides and a base. The base is hingedly attached to one side. The compactor plate can be received in the container so that material in the container can be compacted by the plate. A housing in the container top allows lifting of the container for unloading of compacted material by hinging downwardly of the base. This housing comprises a plurality of open mouthed compartments arranged in a circle and extending upwardly outwardly to receive a grapple of a lifting crane for lifting the container.

15 Claims, 5 Drawing Sheets

APPARATUS FOR COMPACING GARBAGE AND SALVAGE

FIELD OF THE INVENTION

This invention relates to a compactor, particularly to a compactor useful in the compacting of garbage or salvage. The compactor is useful, however, with any material to be compacted on a large scale.

DESCRIPTION OF THE PRIOR ART

The disposal of garbage represents a considerable problem. Garbage is generated at a prodigous rate in the modern world and there are wide ranges of methods of disposing of it, most controversial. However, it is clearly desirable that the garbage be compacted much as possible to reduce its volume prior to disposal. The present invention finds application in the compacting of garbage.

Compactors for garbage are well known. Prior art known to applicant includes U.S. Pat. Nos. 3,862,595 to Longo; U.S. Pat. No. 3,861,296 to Clar; U.S. Pat. No. 3,869,978 to Steinberg; U.S. Pat. No. 3,911,807 to Birnbaum; U.S. Pat. No. 3,921,515 Eckerle; U.S. Pat. No. 3,945,314 to Hennells; U.S. Pat. No. 3,765,148 to Ippolito; U.S. Pat. No. 3,756,150 to Bourgeois.

The above references are examples of typical garbage compactors using hydraulic rams to compact the garbage. However, the means of disposing of the compacted garbage, particularly the means of unloading it from the garbage compactor is the feature of the present invention.

SUMMARY OF THE INVENTION

Accordingly, the present invention provides a compactor comprising a frame with a fluid operated, double acting ram mounted on the frame. A compactor plate is slidably mounted in the frame to be reciprocable by the ram. A back plate is positioned at an end of the frame remote from the ram. A container receives material to be compacted. The container is mounted adjacent the back plate. The container is open ended and has a top, sides and a base. The base is hingedly attached to one side. The compactor plate can be received in the container so that the material in the container can be compacted by the plate. A housing in the container top allows lifting of the container for unloading of compacted material by hinging downwardly of the base.

In a particularly preferred embodiment the lifting means comprises a plurality of open mouthed compartments adapted to receive a grapple of conventional form. This greatly facilitates the unloading of the container.

DESCRIPTION OF THE DRAWINGS

Aspects of the invention are illustrated, merely by way of example, in the drawings in which.

DESCRIPTION OF THE PREFERRED EMBODIMENTS

Figure 1:
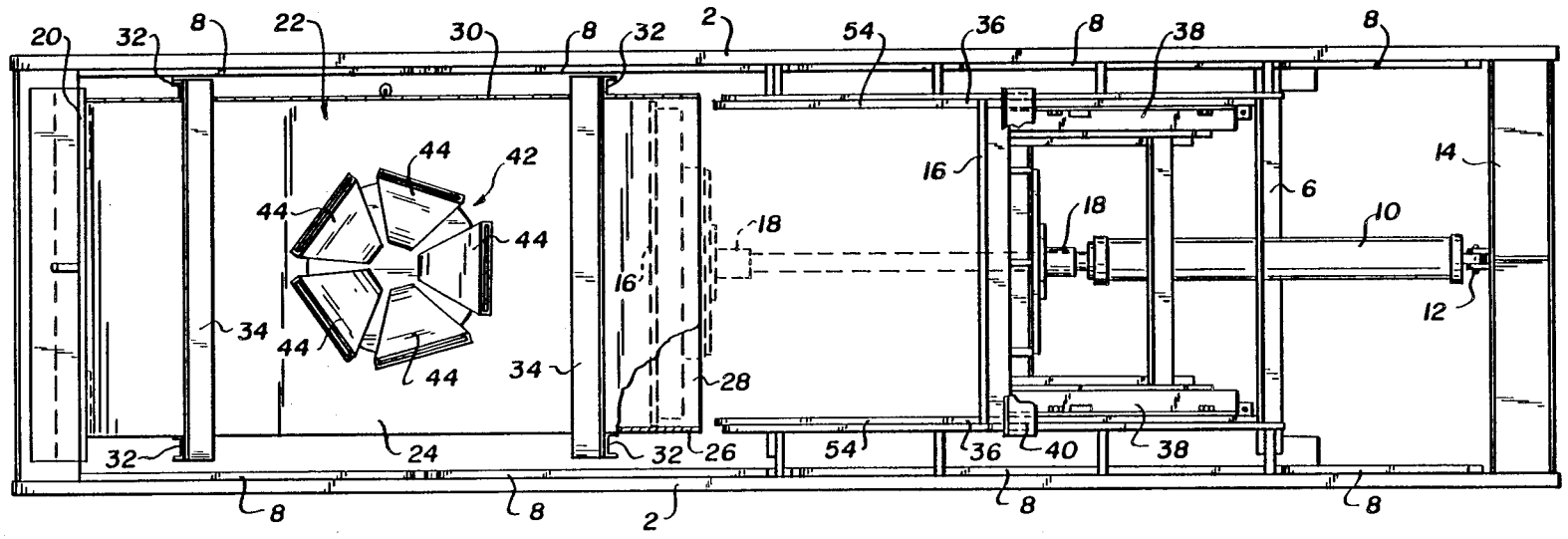
FIG. 1 is a plan view of a compactor according to the present invention.
Figure 2:
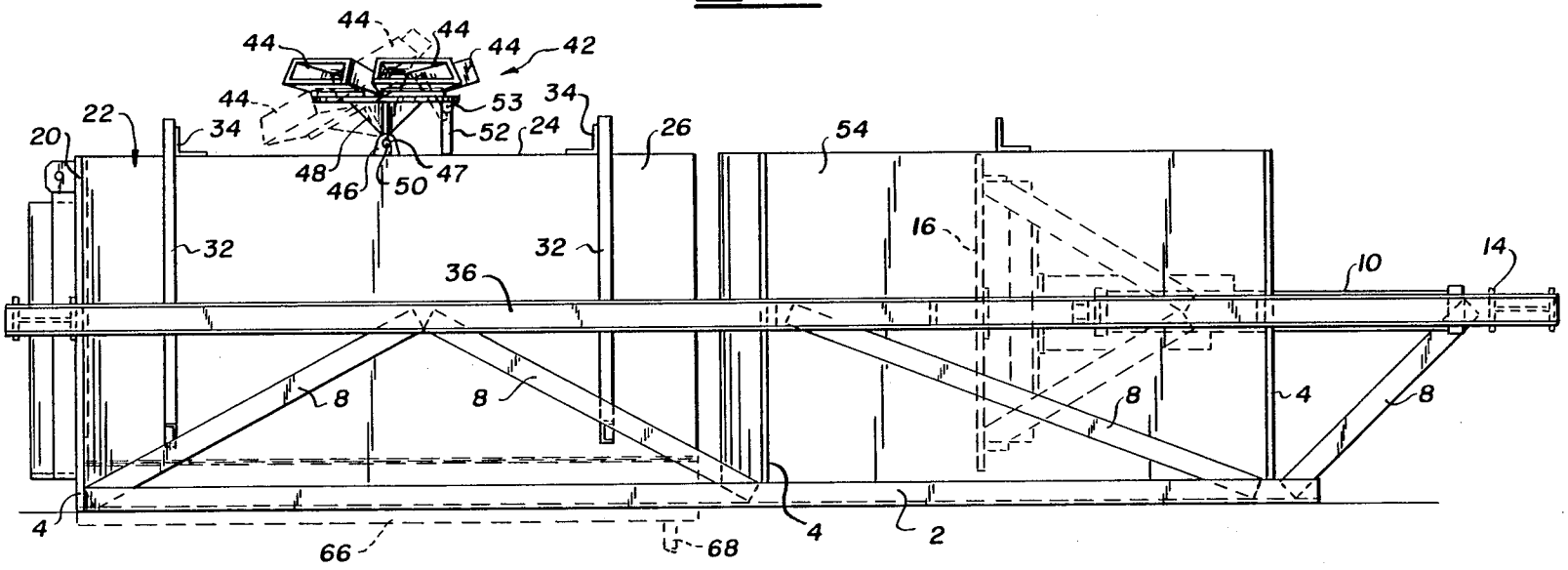
FIG. 2 is a side elevation of the compactor of FIG. 1.

The drawings show a compactor comprising a frame made up of longitudinal members 2, upstanding members 4 and cross members 6, each made of angle bar or other appropriately strong components. For additional strength there are triangulated bracing members 8. There is a hydraulic ram 10 mounted on the frame. As shown particularly in FIGS. 1 and 2, the ram is pivotably mounted at 12 on a cross strut 14 in the frame. There is a compactor plate 16 slidably mounted in the frame to be reciprocated by the ram 10 to which it is connected at 18. The compactor also includes a back plate 20 at the end of the frame remote from the ram 10. A container 22 to receive material is positionable in the frame as shown in FIGS. 1 and 2. The container 22 is mounted adjacent the back plate 20, as shown particularly in FIG. 3. It comprises an open ended body having a top 24 sides 26 and a base 28, the base being hingedly attached to one side at 30. The container can be positioned in the frame so that one open end abuts the back plate 20. The container 22 is braced by braces 32 and 34 and by end braces 29 in the open end to be positioned adjacent back plate 20.

The compactor plate 16 is slidably mounted in the frame by longitudinal guide rails 36 that extend along the frame and are of square section tubing formed with an opening. There are tubular bars 38 extending rearwardly from the compactor plate 16, shown particularly in FIG. 1, with flanges 39 extending from bars 38. Rollers 40 on bars 38 and flanges 39 engage the guide rails 36 so that the movement of the compactor plate 16 is guided and restricted as it is moved back and forth by the hydraulic ram 10.

The compactor plate 16 is dimensioned to be received in the container 22 as a fairly close fit, in particular to enable material in the container to be compacted by the plate 16 as it is moved forward under the influence of the hydraulic ram 10.

Figure 3:
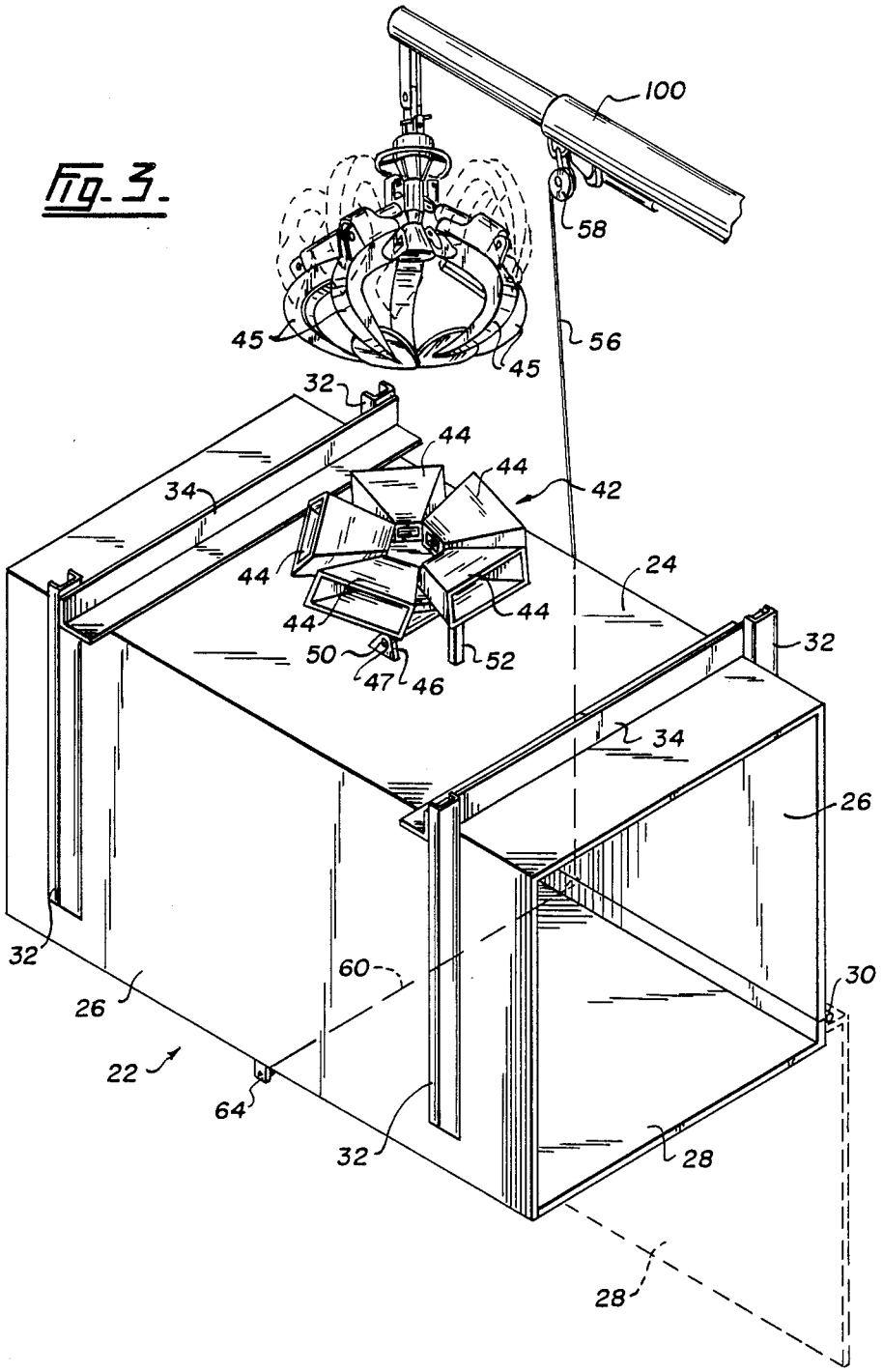
FIG. 3 is a detail view showing the container of the compactor of FIGS. 1 and 2.
Figure 5:
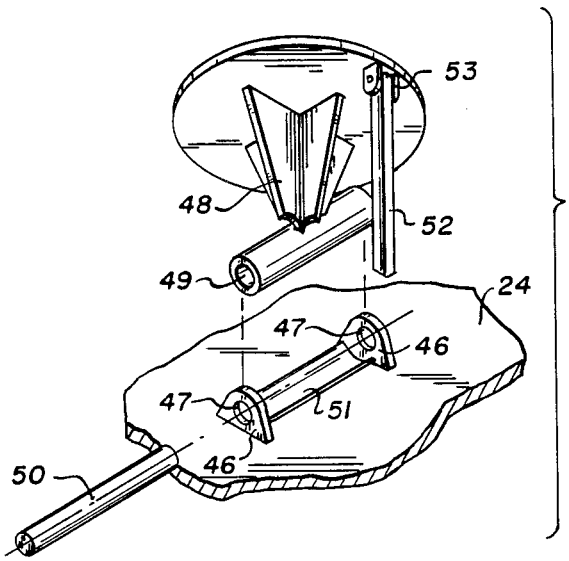
FIG. 5 shows the lifting means in a preferred embodiment of the invention.
Figure 6:
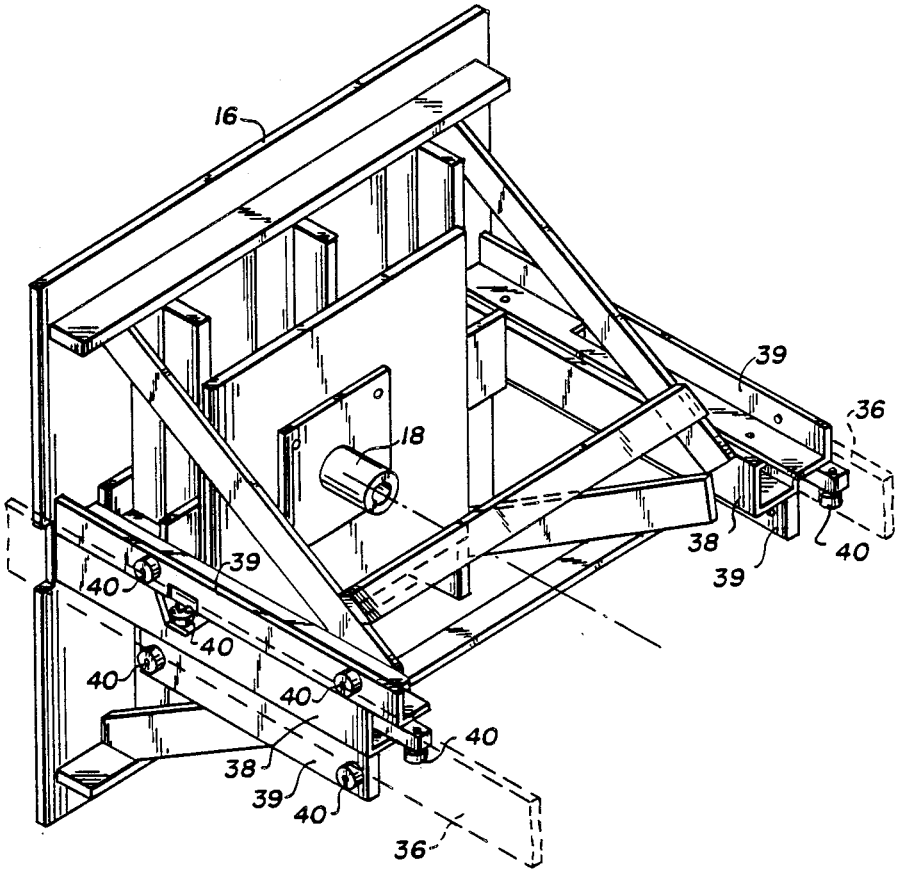
FIG. 6 shows a detail view of the compactor.

The compactor includes lifting means 42 on the container 22 to allow lifting of the container and loading of compacted material by the base 28 hinging downwardly, as shown in FIG. 3. As shown particularly in FIGS. 2 and 3, the lifting means 42 comprise a plurality of open mouthed compartments 44, of generally truncated triangular section adapted to receive the prongs 45 of a typical five pointed grapple, mountable on a conventional crane 100. To this end the compartments 44 are arranged in a circle and extend outwardly upwardly as shown most clearly in FIG. 3. The lifting means 42 is pivotably mounted on the container by the provision of a pair of spaced housings 46 with openings 47 on the top 24 of the container 22. A projection 48 extends downwardly from the lifting means 42 and is formed with a passageway 49 that can align with the openings 47 in the spaced housings 46. A pivot pin 50 is journalled in the housings 46 and the passageway 49 to define a pivotal axis. The pivoting is restricted by the provision of abutment bar 52 extending between the top 24 of the container 22 and the underside of the lifting means 42. Bar 52 is pivotally mounted at 53 - see FIG. 5.

Although the drawings show there is spaced housings 47 on the container with the passageway 49 on the lifting means the converse arrangement is equally appropriate.

The mounting means 42 is mounted so that the container 22 tends to pivot when lifted on crane 100. This facilitates end unloading. Pivoting is restricted by bar 52 but bar 52 can, if required, be pivoted out of the way. It should also be noted that mounting means 42 can be removed from the container 22 by removing pin 50 so that one mounting means 42 can be attached to a number of containers 22. For ease of transport bar 52 can be pivoted up. Semi-cylindrical member 51 is provided between housings 46 to facilitate positioning of pin 40 in openings 47 and, in particular, the alignment of passageway 49 with openings 47.

In order to bestow rigidity to the compactor the ram 10, extending through walls 54, is welded to the frame to restrict the travel of the ram 10 and the compactor plate 16.

Figure 4:
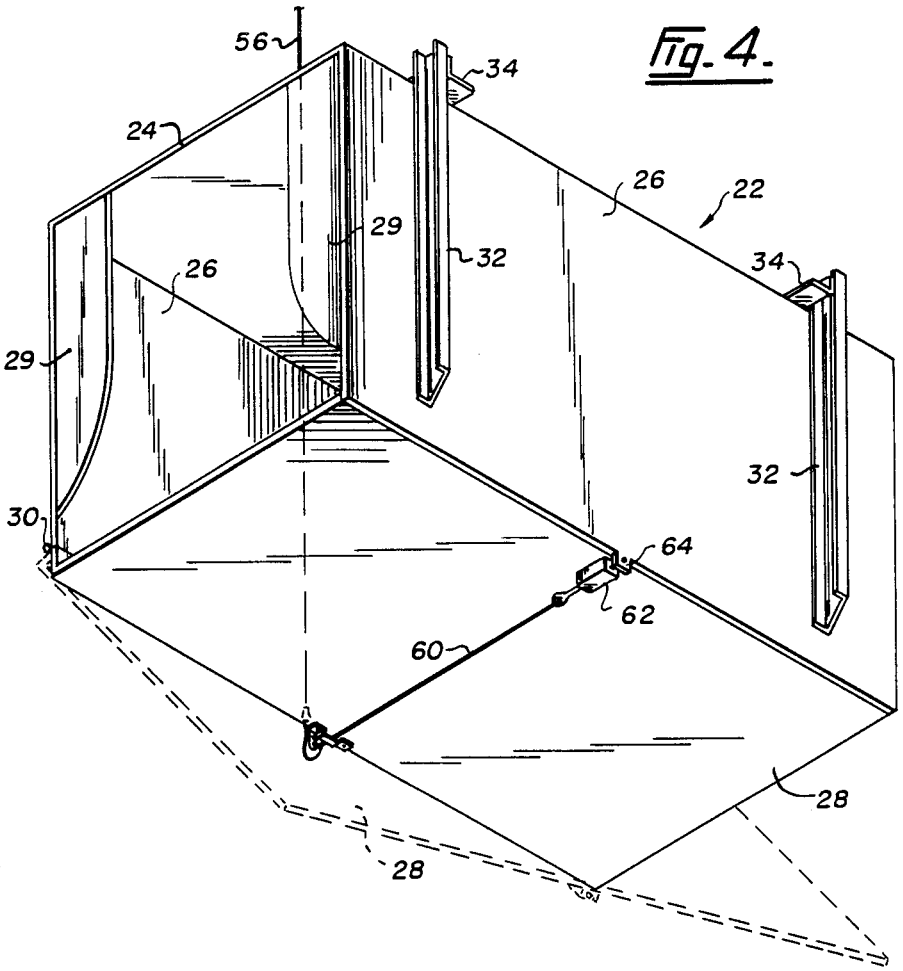
FIG. 4 is a detail view similar to FIG. 3.

As shown in FIGS. 3 and 4 the base 28 is hingedly attached to the container 22 along one side 26 at 30. Cable 56 extends downwardly over sheave 58 on crane 100. Cable 56 is attached to a rod 60 and to a spring loaded catch 62, (the spring of which is not shown) that engages with a recess 64 on side 26. The arrangement is such that pulling upwardly on the cable 56 by, for example, a simple winch, releases the spring loaded catch 62 so that the base 28 can be hinged downwardly as shown in FIG. 4. The catch 62 can be reattached simply by pushing the two components together when the spring loaded catch 62 engages in the openings 64.

It should also be noted that an under tray 66, to receive liquid from the garbage or salvage compressed in the container 22 is provided beneath the longitudinal members 2 as shown in FIG. 2. The tray may be provided with an outlet 68. The bylaws of many municipalities require that this feature be present.

Although not shown in the drawings, typically the compactor will include a prime mover, for example, a 40 hp electric motor, driving a hydraulic motor to generate sufficient hydraulic pressure for the hydraulic ram and gear reducer interposed between the electric motor and the hydraulic motor in conventional manner.

In use container 22 for garbage is located on the frame as shown in FIGS. 1 and 2. Garbage is then loaded into the open end of the container. At an appropriate moment the motor is run to generate hydraulic pressure and the ram 10 extends to move the compactor plate 16 into the container to compact the garbage. As is known in the art substantial pressures are generated by this means.

Once a load of garbage has been compacted, the ram 10 is retracted and more garbage is loaded. The cycle is repeated until the container 22 is full.

A conventional grapple mounted on a crane, is then moved into position and the prongs engaged in the openings in lifting means 42. The container 22 can then be lifted with ease. Once lifted, the container 22 is moved to an appropriate position, typically above a dumping truck, and the releasable means for the hinged base 28 are released to allow the base to hinge downwardly under its own weight. The compacted garbage then falls into the truck.

The empty container 22 is then returned to the frame of the compactor for refilling. Garbage is then transported, when necessary, to a disposal site.

Although the illustrated embodiment shows bottom unloading of the container 22 it will be appreciated by the skilled man that end unloading by tipping of the container 22 is equally appropriate, especially with the mounting means 42 as illustrated. Although not shown in the drawings the bottom unloading container is provided with walls 26 having a slight downward outward inclination to help unloading.

Furthermore, although container 22 is shown of a generally rectangular cross-section it will also be appreciated the a large number of shapes would be appropriate. Given the illustrated structure the rectangular section container 22 is particularly appropriate for the illustrating embodiment.

If necessary, the safety chain can be provided from the grapple to the compartments, in case the grapple opens in use. The chain restricts movement of the grapple. Two grapples may be required and will avoid inadvertent dumping of the load.

I claim:

1. A compactor comprising:

a frame;

a fluid operated, double acting ram mounted on the frame;

a compactor plate slidably mounted in the frame to be reciprocable by the ram;

a back plate at an end of the frame remote from the ram;

a container to receive material to be compacted, the container being adapted to be mounted adjacent the back plate, the container being open ended and having a top, sides and a base, the base being hingedly attached to one side;

the compactor plate being dimensioned to be received in the container so that material in the container can be compacted by the plate;

lifting means on the container top comprising a plurality of open mouthed compartments adapted to receive a grapple to allow lifting of the container for unloading of compacted material by hinging downwardly of the base.

2. A compactor as claimed in claim 1 including a cross strut in the frame to mount the ram.

3. A compactor as claimed in claim 1 including means to releasably fasten the base of the container.

4. A compactor as claimed in claim 1 including guide rails for the compactor plate extending along the frame.

5. A compactor as claimed in claim 4 including bars mounted to the compactor plate;

openings in the guide rails to receive and guide the bars mounted to the compactor plate.

6. A compactor as claimed in claim 1 in which the compartments are arranged in a circle and extend upwardly outwardly.

7. A compactor as claimed in claim 1 in which the lifting means is pivotably mounted on the container.

8. A compactor as claimed in claim 7 including means to restrict pivoting of the lifting means.

9. A compactor as claimed in claim 7 in which the means to restrict pivoting of the lifting means comprises an abutment bar extending between the top of the container and the underside of the lifting means.

10. A compactor as claimed in claim 7 in which the pivotable mount comprises a pair of spaced housings on one of the container and the lifting means;

a passageway in one of the lifting means and the container; and a pivot pin journalled in the housings and the passageway to define a pivotal axis.

11. A mounting means for a container to be lifted by a graple, the mounting means comprising:

a plurality of open-mouthed compartments, each compartment adapted to receive an arm of a grapple;

a pivotal mount for attaching the compartments to the top of the counter whereby the grapple can engage in the compartments to lift and support the container.

12. A mounting means as claimed in claim 11 in which the lifting means is pivotally mounted on the container.

13. A mounting means as claimed in claim 12 in which the means includes means to restrict pivoting of the lifting means.

14. A mounting means as claimed in claim 13 in which the means to restrict pivoting of the lifting means comprises an abuttment bar extending between the top of the container and the underside of the lifting means.

15. A lifting means as claimed in claim 11 in which the pivotal mount comprise a pair of spaced housings on one of the container and the lifting means;

a passageway in one of the lifting means of the container and a pivot pin journalled in the housings and the passageway to define a pivotal axis.

* * * * *